United States Patent [19]

Davey

[11] Patent Number: 4,944,265

[45] Date of Patent: Jul. 31, 1990

[54] OIL RESTRICTING HEAD GASKET CONSTRUCTION

[75] Inventor: Mark A. Davey, St. Clair Shores, Mich.

[73] Assignee: Chrysler Corporation, Highland Park, Mich.

[21] Appl. No.: 383,504

[22] Filed: Jul. 24, 1989

[51] Int. Cl.[5] ..... F01M 1/00

[52] U.S. Cl. ..... 123/196 R; 123/41.84; 277/235 B

[58] Field of Search ..... 123/196 R, 196 M, 193 C, 123/41.84; 277/235 B

[56] References Cited

U.S. PATENT DOCUMENTS

| | | | |
|---|---|---|---|
| 2,084,054 | 6/1937 | Balfe | 277/235 B |
| 4,373,735 | 2/1983 | Morsbach et al. | 277/235 B |
| 4,638,769 | 1/1987 | Ballheimer | 123/193 C |
| 4,791,891 | 12/1988 | Kubis et al. | 123/193 C |
| 4,830,383 | 5/1989 | Probst | 277/235 B |

*Primary Examiner*—E. Rollins Cross

*Attorney, Agent, or Firm*—Kenneth H. MacLean, Jr.

[57] ABSTRACT

In an internal combustion engine having an engine block and a cylinder head, a pair of axially offset lubricating oil passsages in the block and the head respectively positioned so that there is no direct axial communication therebetween and with a gasket therebetween with openings corresponding to the pair of passages and a restricted communicating structure therebetween for limiting the flow of oil from the block to the head.

4 Claims, 1 Drawing Sheet

OIL RESTRICTING HEAD GASKET CONSTRUCTION

BACKGROUND OF THE INVENTION

1. Field of Invention

The present invention relates to an internal combustion engine and particularly to a cylinder head gasket construction which restricts the supply of lubricating oil from the engine oil pump to the valve components in the cylinder head.

2. Description of the Related Art

Usually, in an internal combustion engine with overhead valves, it is desirable to restrict the flow of lubricating oil which is pumped through the block to the cylinder head. Too great a supply of oil to the cylinder head is undesirable and unnecessary.

In the typical engine such as the Chrysler Motors Corporation 2.2 and 2.5 liter four cylinder engine family, restriction of oil flow between passages in the block and head is accomplished by mounting a cup shaped oil restrictor device in one of the passages. This works well but necessitates an additional part and a mounting operation.

SUMMARY OF THE INVENTION

The subject application describes an improved oil restrictor for an internal combustion engine. Specifically, an oil supply passage in the engine block and another passage in the cylinder head have axes which are offset from each other therefore precluding axial flow of oil between the passages. A head gasket has openings therethrough corresponding to the passages which the gasket overlies. The gasket has a narrow passage formed between the openings. This narrow passage provides a restrictive path for the lubricating oil to follow as it passes from the engine block passage to the cylinder head passage.

Desirably, the above described narrow passage can be easily modified in width to provide design flexibility for oil flow between the block and the head. Also, this construction eliminates a part and an assembly operation in that a separate restrictor device is no longer needed.

The details as well as other features and advantages of a preferred embodiment of this invention are set forth in the remainder of the specification and are shown in the drawings.

IN THE DRAWINGS

FIG. 1 is a sectioned view of an engine block, gasket and cylinder head showing the present way of restricting oil flow; and FIG. 2 is a planar fragmentary view of a cylinder gasket and the associated engine block of the present invention; and FIG. 3 is an enlarged sectioned view taken along section line 3—3 in FIG. 2 and looking in the direction of the arrows.

DETAILED DESCRIPTION OF EMBODIMENTS

Figure 1:
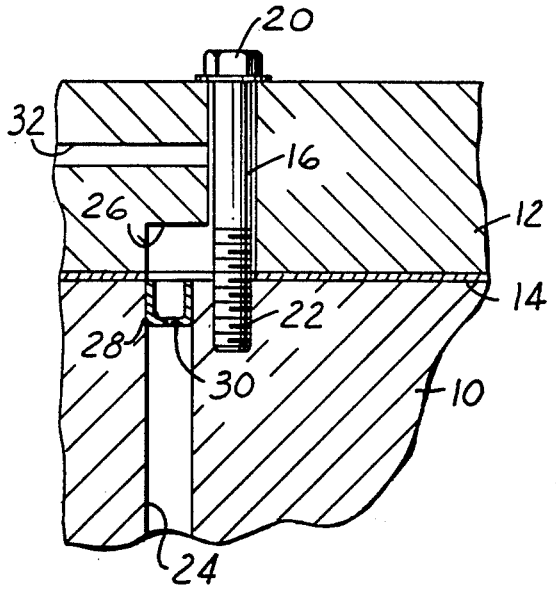
(PRIOR ART) FIG.1

FIG. 1 shows the above described prior art and is so labeled. It shows currently used structure to restrict oil flow to the cylinder head. Specifically, a portion of an engine block 10 and a portion of a cylinder head 12 are illustrated. A thin gasket 14 extends between the block 10 an the head 12. A head bolt 16 extends through a passage 18 in the cylinder head 12. The bolt is smaller than the diameter of the passage 18 so that an annular flow passage is formed therebetween. The bolt 16 has an enlarged head or end 20 and a threaded end portion 22 which is secured to the block 10.

The engine block in FIG. 1 has a passage 24 for the movement of lubricating oil. The oil is pumped from the engine crankcase (not shown) by a pump (not shown). The cylinder head has a milled cavity 26 which connects the passages 18 and 24. A cup shaped flow restricting device 28 is pressed into the passage 24 and has a small opening 30 in its end. The device 28 limits the flow of oil passing from passage 24 to passage 18 through cavity 26. The additional passage 32 in the cylinder head leads from the passage 18 to camshaft bearings or the like (not shown).

Figure 2:
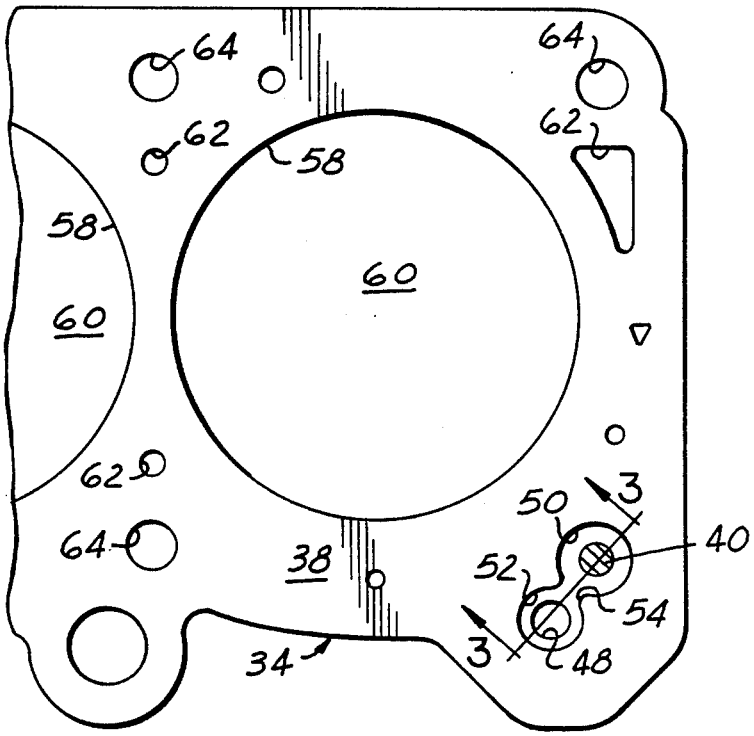
Figure 3:
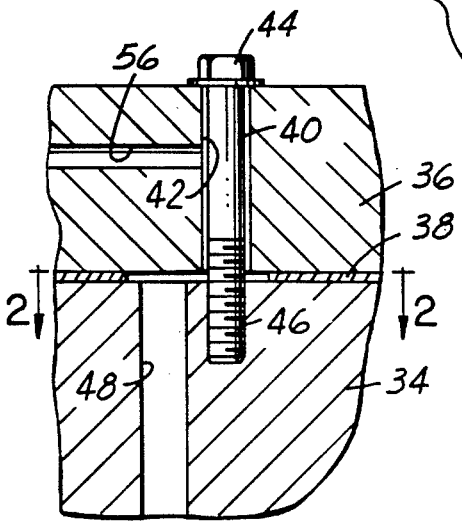

In FIGS. 2 and 3, the subject improved structure for limiting oil flow is shown. An engine block 34 and cylinder head 36 are illustrated. A gasket 38 is located between the members 34 and 36. The head 36 is attached to the block 34 by a bolt 40. The bolt extends through a passage 42 in the head 36. The bolt is smaller than the diameter of the passage so that an annular passage for oil is formed therebetween. The bolt 40 has an enlarged head or end 44 and a threaded end 46. The end 46 is secured to the block 34.

The engine block 34 has a passage 48 therein for the movement of lubricating oil from the pump (not shown) to the cylinder head. From FIG. 2, it can be easily understood that the axis of the passage 48 is offset from the axis of the passage 42. Also, the offset is sufficient so that direct axial flow from the passage 48 to the passage 42 is precluded. Instead, the offset necessarily requires a radially directed flow.

Referring to FIG. 2, the gasket 38 has an opening 50 corresponding to and aligned with the passage 42. Gasket 38 also has another opening 52 corresponding to and aligned with the passage 48. The openings 50 and 52 are insufficient in diameter to overlap. A narrow channel or cut 54 is formed in the gasket 38 to interconnect the two openings 50 , 52. Accordingly, the flow of oil from passage 48 to passage 42 must flow through the restrictive passage formed by the channel 54 and between the block 34 and the head 36. Note, that there is no longer a need to insert a restrictor device in the passage or to form a milled cavity. As in the embodiment shown in FIG. 1, a camshaft lubrication passage 56 extends in the head 36 from passage 42 to a camshaft journal (not shown).

In FIG. 2, the circular openings 58 represent the locations of the cylinders of the block 34. The cylinders 58 support the piston 60 for reciprocation as is well known. There are other openings such as 62 for allowing the passage of the coolant between the block and the head. Also, there are other openings such as 64 for passage of additional cylinder head bolts (not shown).

Although only a single embodiment of the invention is shown in the drawings and described in detail heretofore, it is clear that modifications may be contemplated without falling outside the scope of the invention as claimed hereafter.

I claim:

1. In an internal combustion engine having an engine block and an overlying cylinder head attached to the block, an improved restricted oil supply for valve components supported by the cylinder head, comprising: an oil passage in the engine block extending to the cylinder head; another oil passage in the cylinder head extending to the engine block; the axes of the passages being laterally offset from one another sufficiently so that there is not a direct axial connection therebetween; a gasket extending between the engine block and the cylinder head, the gasket having openings therethrough corresponding to the passages in the block and the cylinder head respectively; the gasket defining an oil flow restrictive channel between the openings therein and between the block and cylinder head for limiting the flow of lubricating oil from the block to the cylinder head.

2. An internal combustion engine, comprising: an engine block; a cylinder head attached to the engine block; a gasket between the block and the head; a source of pressurized oil associated with the block; means including an oil passage through the block to transport pressurized oil from the source to the cylinder head; another oil passage in the cylinder head for receiving the pressurized oil; from the engine block the oil passages having their axes laterally offset from one another to preclude direct axial flow of oil therebetween; the gasket having openings therethrough corresponding to the oil passages and a gasket configuration between the openings to define a relatively small passage between the block and head for limiting the flow of oil from the source to the head.

3. The restricted oil supply of claim 1 in which the passage formed in the cylinder head is of sufficient size so that a cylinder head fastener can be inserted therethrough for the purpose of attaching the head to the block.

4. The restricted oil supply of claim 1 in which the gasket openings are dimensioned and positioned so that they slightly overlap so that the restrictive narrow passage is formed thereby.

* * * * *